US009395133B2

(12) United States Patent
Milde, Jr. et al.

(10) Patent No.: US 9,395,133 B2
(45) Date of Patent: Jul. 19, 2016

(54) SECURE SMARTPHONE-OPERATED GUN TRIGGER LOCK

(71) Applicants: Karl F. Milde, Jr., Mahopac, NY (US); Jeffrey A. Matos, New Rochelle, NY (US)

(72) Inventors: Karl F. Milde, Jr., Mahopac, NY (US); Jeffrey A. Matos, New Rochelle, NY (US)

( * ) Notice: Subject to any disclaimer, the term of this patent is extended or adjusted under 35 U.S.C. 154(b) by 32 days.

(21) Appl. No.: 14/640,290

(22) Filed: Mar. 6, 2015

(65) Prior Publication Data

US 2015/0184965 A1 Jul. 2, 2015

Related U.S. Application Data

(60) Continuation of application No. 14/511,222, filed on Oct. 10, 2014, now Pat. No. 9,222,740, which is a division of application No. 13/763,951, filed on Feb. 11, 2013, now Pat. No. 8,893,420.

(60) Provisional application No. 61/761,270, filed on Feb. 6, 2013.

(51) Int. Cl.

| | |
|---|---|
| ***G07C 9/00*** | (2006.01) |
| ***F41A 17/06*** | (2006.01) |
| ***F41A 35/00*** | (2006.01) |

(52) U.S. Cl.

CPC ..... *F41A 17/063* (2013.01); *F41A 17/066* (2013.01); *F41A 35/00* (2013.01); *G07C 9/00174* (2013.01)

(58) Field of Classification Search

CPC ..... F41A 17/063; F41A 17/06; F41A 17/066; G07C 9/00; G07C 9/00174; G06F 3/0484; G06F 3/0482

USPC ..... 340/5.1–5.9; 42/70.04–70.08

See application file for complete search history.

(56) References Cited

U.S. PATENT DOCUMENTS

| | | | | |
|---|---|---|---|---|
| 2008/0162352 | A1* | 7/2008 | Gizewski | G06F 19/345 705/50 |
| 2014/0057255 | A1* | 2/2014 | Holmes | G06F 19/366 435/6.11 |
| 2014/0215882 | A1* | 8/2014 | Milde, Jr. | F41A 17/066 42/70.06 |

* cited by examiner

*Primary Examiner* — Allen T Cao

(74) *Attorney, Agent, or Firm* — Karl F. Milde, Jr.

(57) ABSTRACT

A battery-powered trigger-locking device, which is configured to be disposed on a gun with a trigger for firing, includes a data receiver, a data memory and a logic device for determining whether data received by the receiver is the same, or substantially the same, as data stored in the memory. If a data match is indicated, the logic device causes an electromagnetic device to move a trigger-locking member to an unlocked position, permitting the gun to be fired. A separate electronic gun key is provided to transmit gun unlock data to the data receiver of the trigger-locking device. This gun unlock data may be a password, a long pseudo-random number or biologic data identifying the gun owner or some other person who is licensed or otherwise authorized to fire the gun.

7 Claims, 4 Drawing Sheets

SECURE SMARTPHONE-OPERATED GUN TRIGGER LOCK

CROSS-REFERENCE TO RELATED APPLICATION

This application is a continuation of application Ser. No. 14/511,222 filed Oct. 10, 2014 entitled "SECURE SMARTPHONE-OPERATED LOCKING DEVICE" which, in turn, a division of application Ser. No. 13/763,951 filed Feb. 11, 2013, entitled "SECURE SMARTPHONE-OPERATED GUN TRIGGER LOCK" (now U.S. Pat. No. 8,893,420).

BACKGROUND OF THE INVENTION

The present invention relates to a gun lock for a trigger-operated gun which is designed to be installed on the gun in a position behind the trigger to prevent the trigger from firing the gun.

Mechanical gun locks are designed to be installed on the gun in a position behind the trigger to prevent the trigger from firing the gun. These gun locks use a mechanical key that can be easily duplicated, and the locks themselves can be compromised by means of a master key or a look pick.

Furthermore, such gun looks can be opened by anyone in possession of one of the keys. With such gun locks it is not possible to restrict the use of the gun to the gun owner or to some other person who is licensed or otherwise authorized to use the gun.

SUMMARY OF THE INVENTION

It is a principal object of the present invention to provide a gun look for a trigger-operated gun which is difficult to compromise and allows only the gun owner, or some other person who is licensed or otherwise authorized to use the gun.

This object, as well as other objects which will become apparent from the discussion that follows, is achieved, in accordance with the present invention, by providing a battery-powered trigger-locking device which is configured to be disposed on a gun of the type having a trigger for firing. The trigger-locking device includes a data receiver, a data memory and a logic device for determining whether data received by the receiver is the same, or substantially the same, as data stored in the memory. If a data match is indicated, the logic device causes an electromagnetic device to move a trigger-locking member to an unlocked position, permitting the gun to be fired.

According to a preferred embodiment of the invention, the gun lock device according to the invention further comprises an electronic gun key having a data transmitter for transmitting gun unlock data to the data receiver of the trigger-locking device. This gun unlock data may be a password, a long pseudo-random (and therefore hack-resistant) number or biologic data identifying the gun owner or some other person who is licensed or otherwise authorized to use the gun.

More particularly, the trigger-locking device includes:

(a) a stationary member configured to be permanently installed on the gun in a position behind the trigger;

(b) a movable member, movably connected to the stationary member and movable between a locked first position which prevents the trigger from firing the gun and an unlocked second position which enables firing;

(c) electromechanical apparatus disposed on the stationary member for moving the movable member between the first position and the second position in response to at least one electric signal;

(d) a data receiver for receiving a gun unlock signal with gun unlock data;

(e) a data memory for storing data; and (f) a first logic device, coupled to the data receiver and to the data memory, for comparing the gun unlock data received by the receiver with data stored in the memory upon receipt of the gun unlock signal, and for producing the at least one electric signal to actuate the electromechanical apparatus in dependence upon whether the stored data and the received data are substantially the same.

The first logic device is operative in this trigger-locking device to cause the electromechanical apparatus to:

move the movable member to the second position when the gun unlock data received by the receiver is substantially the same as the data stored in the memory, and maintain the movable member in the first position at all other times, thereby to prevent unauthorized operation of the gun.

The data receiver is further operative to receive a gun lock signal, and the first logic device, upon receipt of the gun look signal, is operative to cause the electromagnetic apparatus to move the movable member to the first (locked) position.

The first logic device, upon producing the electric signal, may cause the electromagnetic apparatus to move the movable member to the second position for a first duration of time, and thereafter to move the movable member back to the first position. The first duration of time is preferably selected from the group consisting of:

(i) less than 1 minute;

(ii) a range of time from 1 minute to 5 minutes;

(iii) a range of time from more than 5 minutes to 30 minutes; and (iv) more than 30 minutes.

In an alternative embodiment of the invention, the movable member, after being moved to the second/unlocked position remains in that position until a gun lock signal is received by the data receiver.

A gun key device has a data transmitter for transmitting gun unlock data to the data receiver in the trigger-locking device. As mentioned above, the gun unlock data may include a password, a pseudo-random number or data identifying a putative authorized person who wishes to use the gun. The pseudo-random number is preferably generated by the gun key device when the gun is first used.

According to a preferred embodiment of the invention, the gun key device further comprises:

(a) an input device, for inputting information from a putative authorized person who wishes to unlock the gun; and (b) a second logic device, coupled to both the data transmitter and the input device, for generating gun unlock data defined by the putative authorized person and for causing the data transmitter to transmit the gun unlock data to the data receiver. The putative authorized person is recognized as an authorized person if the gun unlock data substantially matches the stored data in the trigger lock data memory.

When a biologic identifier is used to unlock the gun lock, the data stored in the memory of the trigger lock may include at least one biologic identifier of the owner or an authorized person.

The input device of the gun key may be a camera, for example. In this case, the camera is operative to record an image of the putative authorized person as a biologic identifier, which image may be:

a facial image;

an image of an iris;

a retinal image;

a fingerprint;

a palm print; and an image of veins of a hand;

The second logic device is then operative to process the image and to generate the gun unlock data therefrom.

Alternatively, the input device may be a microphone. The second logic device is then operative to process a voiceprint of the putative authorized person as a biologic identifier and to generate the gun unlock data therefrom.

Finally, the input device may be an alphanumeric keyboard, whereby:

(i) the putative authorized person may input an alphanumeric code; and (ii) the putative authorized person is recognized as an authorized person in the event the inputted code matches the stored data.

The trigger-looking device preferably comprises a first battery for providing power to at least one of the logic device, the data receiver and the data memory and a second battery for providing power to the electromechanical apparatus which is power thirsty compared to the electronic devices.

Preferably, an electric device is provided for selectively utilizing the still-functional battery when one of the two batteries is depleted.

Preferably also, the electromechanical apparatus is operative to move the movable member to the first position in the event of battery depletion.

Advantageously, the data memory comprises at least one write-once-only element to prevent degradation of the data stored in the memory and to prevent the data stored in the memory from being changed. The write-once-only element may be a PROM, an EPROM or an EEPROM, for example.

According to a preferred embodiment of the invention, the gun lock apparatus comprises at least one tamper detecting device, situated in proximity to the trigger-locking device, for detecting external manipulation of at least one of (1) the logic device, the (2) electromechanical apparatus, and (3) the moveable member. This tamper detecting device preferably generates a tamper signal upon the detection of the external manipulation, which tamper signal causes the electromechanical apparatus to maintain the movable member in the first position for a second duration of time. The tamper detecting device may be a separate element or it may be implemented by the first logic device.

Advantageously, the trigger-locking device comprises a transmitting device, coupled to the tamper detecting device, for transmitting an alarm upon generation of the tamper signal.

According to still another preferred embodiment of the present invention, the data memory may be operative to store identifying information of a registration person authorized to input data to the data memory which identifies the authorized person. In this case, the first logic device is made operative to store data concerning a person authorized to use the gun, in the data memory only if the authorized person identification information is accompanied by identification of a putative registration person that substantially matches the stored registration person identification information. Also, the first logic device is made operative to change the data stored in the data memory only if the identification information is accompanied by identification of a putative registration person that substantially matches the stored registration person identification information.

Finally, according to still another preferred embodiment of the present invention, the electromechanical apparatus includes an electric motor coupled to a gear reduction mechanism for rotating a cam. The movable member of the trigger-locking device is moved by the can between the locked first position and the unlocked second position.

Alternatively, the electric motor may be a servo-motor which is coupled mechanically to the movable member to move this member back and forth between the two positions.

In yet another alternative embodiment of the invention, an electromagnetically controlled two position switching device may be used to control the position of movable member.

For a full understanding of the present invention, reference should now be made to the following detailed description of the preferred embodiments of the invention as illustrated in the accompanying drawings.

BRIEF DESCRIPTION OF THE DRAWINGS

FIG. 5, comprising

DETAILED DESCRIPTION OF THE PREFERRED EMBODIMENTS

Figure 1:
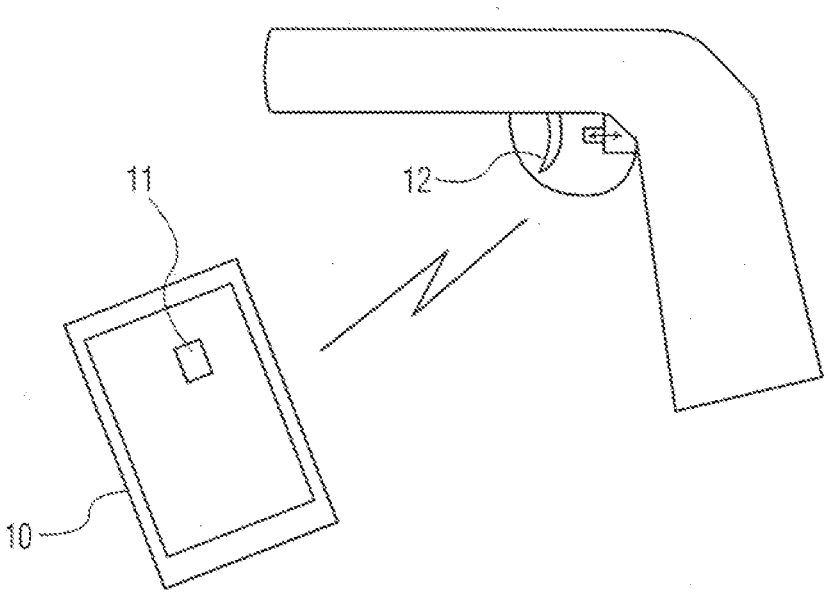
FIG. 1 is a representational diagram showing a smartphone and a gun that is equipped with a gun lock according to the present invention.

The preferred embodiments of the present invention will now be described with reference to FIGS. 1-5 of the drawings. Identical elements in the various figures are identified with the same reference numerals.

Briefly in overview, a battery-operated trigger-locking device is permanently attached to/installed in a gun in a recess behind the trigger in the lower receiver mechanism. In its default condition, a movable member is in a forward position, blocking rearward movement of the trigger. When unlocked, the movable member is drawn rearward to allow movement of the trigger.

The trigger-locking device has a Bluetooth (or other type) receiver and a stored number. When this particular number is received from a smartphone or similar device, the trigger-locking device moves the movable member rearward releasing the trigger FIG. 1 illustrates this configuration. A smartphone 10 has an App 11 called "Gunlock" that presents a separate button called "Gun Unlock" for each gun the smartphone owner owns or is licensed to use. By pressing the button on the App, the owner sends a password, a pseudo-random number or biologic ID data by a Bluetooth wireless connection to a trigger-locking device 12 installed permanently in a gun, e.g. by a strong adhesive.

Figure 2:
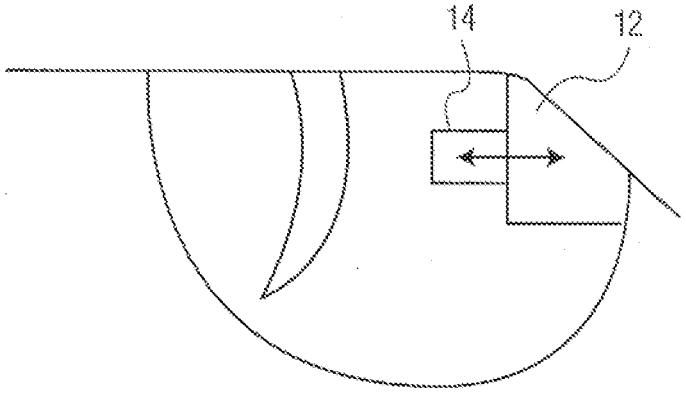
FIG. 2 is a close-up view of the trigger region of the gun of FIG. 1 with the gun lock installed.

FIG. 2 shows the trigger-locking device 12 with a movable member 14. When the device receives a data packet that matches the corresponding data stored in its memory, it draws the movable member 14 back, allowing the trigger to fire the weapon.

The smartphone can be made secure in any number of ways. It can be password protected or, preferably, it can use of its camera to verify the ID of the person holding this device. For example, the security App may use face recognition or iris recognition software to identify the owner from the camera image.

When the trigger lock 12 is first used, the Gunlock App can generate a pseudo-random number and send it to the trigger-locking device for storage in its permanent memory. Once stored, this number can be changed only by an authorized person, such as the gun owner, or a "registration person" that is duly licensed to perform this function, e.g. by a local or national government. Thereafter, whenever the smartphone sends this number again, the trigger-locking device releases the trigger so the gun may be fired. Before sending the unlock number, the user of the smartphone may be required to identify himself/herself by entering biologic identifying information into the phone for a recognition algorithm. Alternatively, the biologic ID information may be sent to the trigger-locking device for matching with corresponding biologic identifying data stored therein. In this case, the biologic identifying data, rather than an unlock number must be originally sent and stored in the data memory.

Firing the gun is therefore a two-step process for the gun owner or authorized user:

(1) Verify his/her identity with the smartphone; and (2) Press the Gun Unlock button to enable the trigger lock to release the trigger.

The trigger remains unlocked until the gun user presses another button on the Gunlock app, appropriately called "Gun Look," or until the trigger lock times out and automatically locks itself by restoring the movable member to the looked position.

The trigger-locking device 12 is preferably powered by a replaceable and/or rechargeable battery (not shown).

Figure 3:
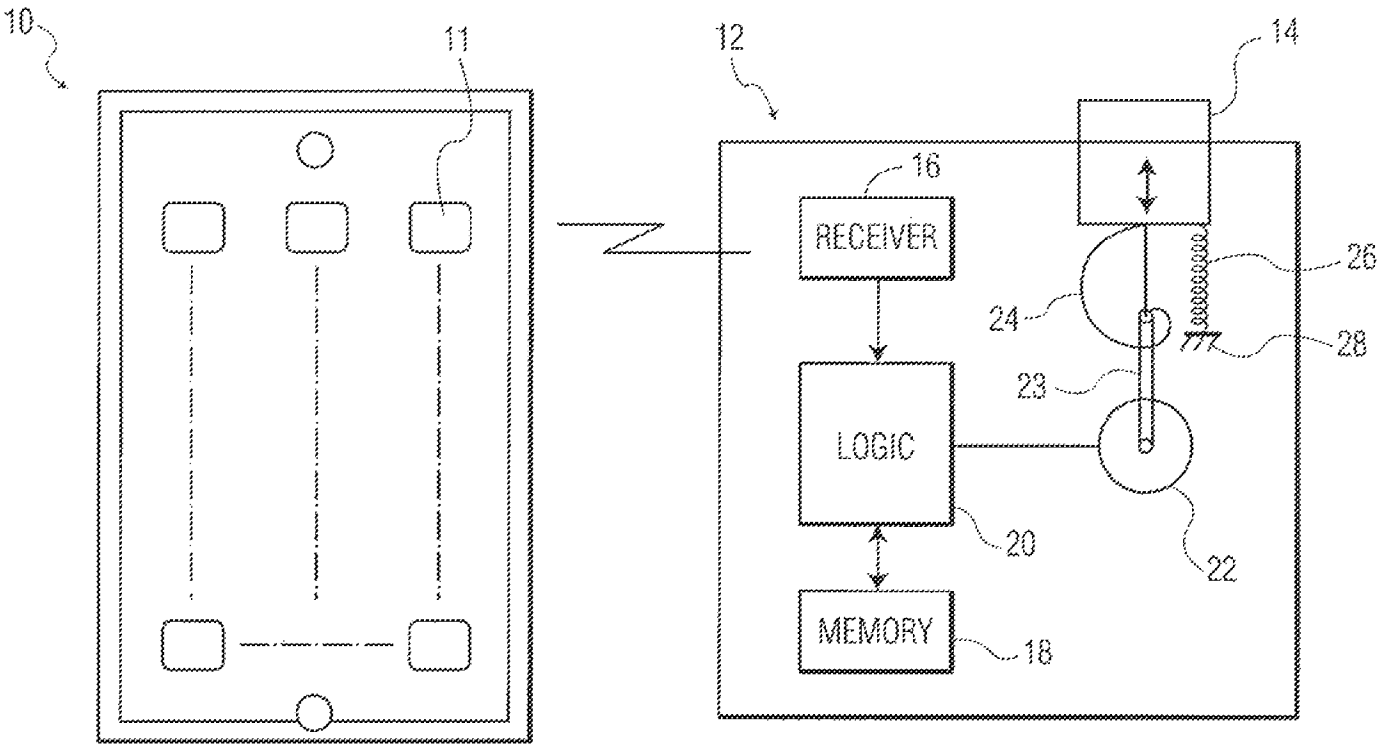
FIG. 3 is a block diagram showing a preferred embodiment of the gun lock apparatus according to the present invention.

FIG. 3 shows the individual elements of the gun look apparatus. The smartphone 10 transmits to a receiver 16 in the trigger-looking device 12, preferably via a wireless Bluetooth connection. Alternatively, the smartphone may be coupled to the receiver by a wire connection, for example through a USB port. The receiver 16 and a data memory 18 are both coupled to a logic device 20 that compares the data received from both the receiver and the memory and sends an electric signal to an electromechanical device 22 when and if there is a match.

If biologic ID data has been sent to the receiver by the smartphone 10, the data may not be an exact match; however, the received signature data may be sufficiently close to the stored signature data to satisfy the requirement that the person holding the smartphone is indeed the owner of the gun.

The electromechanical device is preferably a micro-motor 22 that turns a shaft 23 through a speed reduction gear mechanism. In this way, a very small motor may generate sufficient torque to move the movable member 14 between a locked position, adjacent the gun trigger, and an unlocked position which permits the trigger to fire the gun. The relatively large forces that may be applied against the movable member by the trigger when in the locked position are taken up by a rotatable cam 24, that presses against the movable member against the force of a spring 28. The spring 28, which is connected to a stationary member attached to the gun, biases the movable member 14 toward the unlocked position. The cam 24 abuts a cam surface on the underside of the movable member 14 and, as it rotates, it moves the movable member toward the locked position adjacent the trigger.

Figure 4:
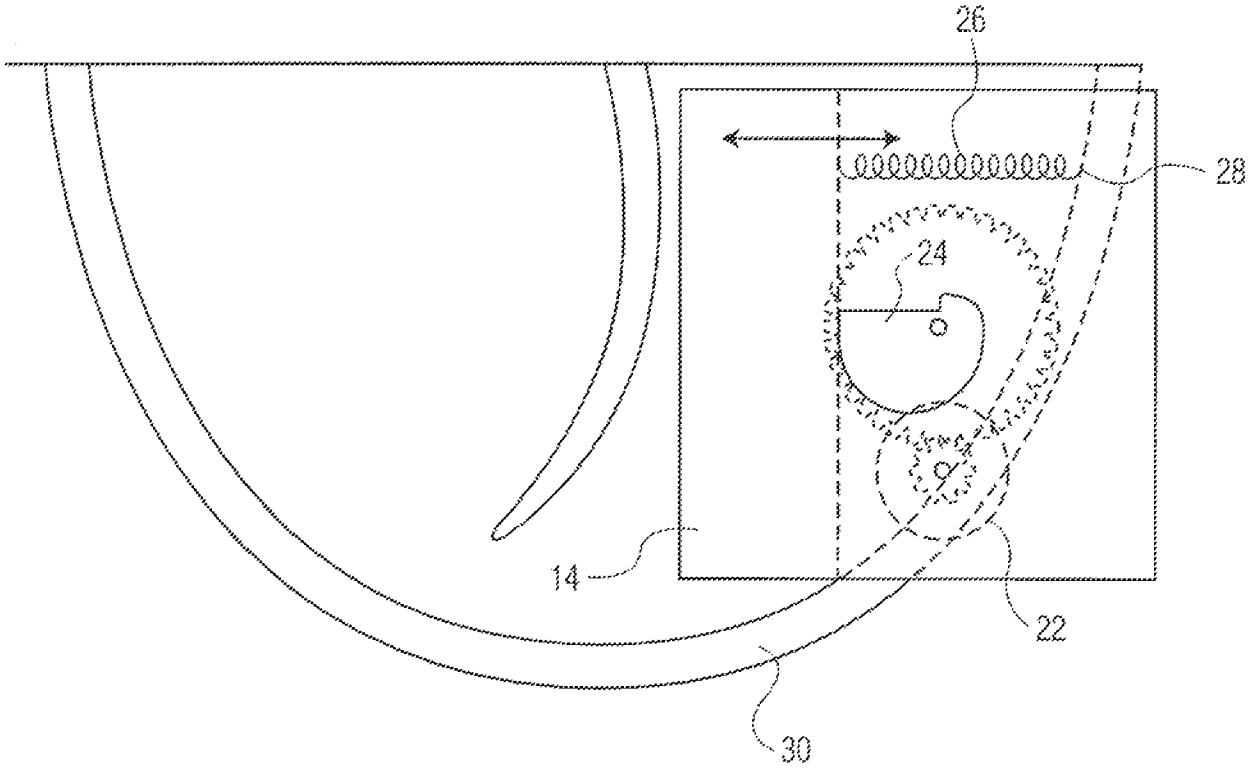
FIG. 4 is a detailed, representational diagram showing a preferred embodiment of the trigger-looking device of the present invention.

FIG. 4 illustrates this electromechanical mechanism in greater detail. The cam 24 is arranged on the reduction gear 23 which is driven by a small gear on the shaft of the motor 22. The spring 26, which is attached at 28 to the trigger guard 30, biases the moveable member in the unlocked position. The cam presses against a flat surface 32 on the inside of the moveable member 14 to move the member 14 to the looked position.

Alternatively, a servo-motor can be substituted for the motor and cam mechanism to move the movable member 14.

The movable member 14 surrounds the trigger guard 30 of the gun in such a way as to prevent tampering. Preferably a tamper detecting device is provided which signals the logic device 20 when it detects tampering so that this device can (1) signal the motor 22 to move the movable member 14 into the looked position, and (2) sound or transmit a warning signal.

Figure 5A:
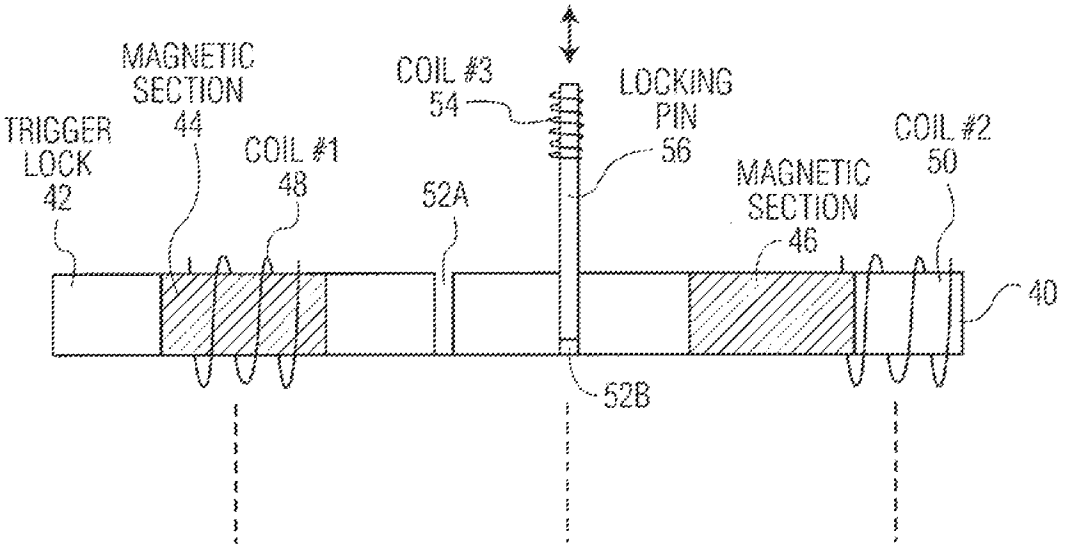
FIGS. 5A and 5B, is a representational diagram showing an alternative embodiment of the electromechanical apparatus used in the trigger-locking device.

FIG. 5 illustrates an alternative embodiment of the electromechanical apparatus for locking and unlocking the trigger-locking device. FIG. 5A shows a movable armature 40 in the locked position (i.e., moved linearly to the left in the figure). This armature presses against the moveable member 14 of the locking device, preventing actuation of the gun trigger. Sections 44 and 46 of the armature contain magnetic material that is actuated by coils 48 and 50. The armature is held in position by a looking pin 56 that is selectively pressed by a third coil 54 into receptacles or detents 52A and 52B in the armature to fix the armature in the unlocked and locked positions, respectively.

Figure 5B:
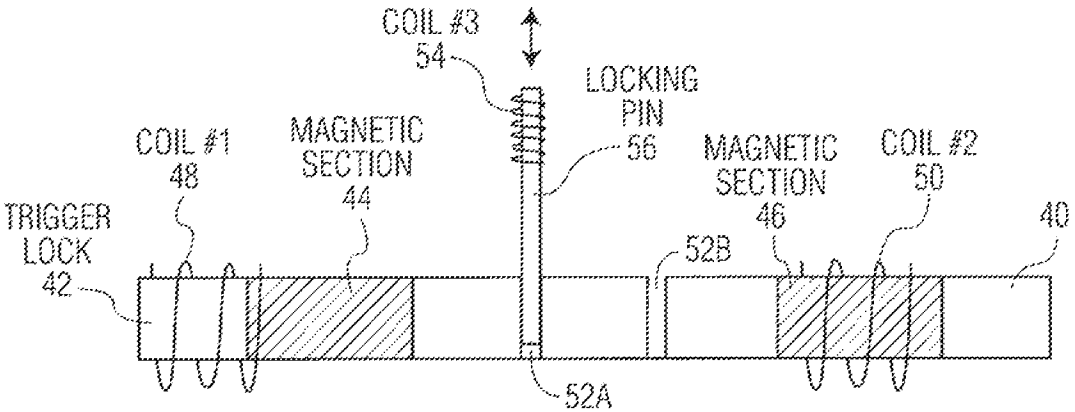

FIG. 5B shows the armature in the unlocked position (moved to the right in the figure).

There has thus been shown and described a novel secure smartphone-operated gun trigger lock which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. Locking apparatus which is unlocked only by an authorized person, said apparatus comprising;

(a) a locking device for securing an item, said locking device having a first source of electrical power and including, in combination:

(1) a locking member, movable between a locked position which secures the item and an unlocked position;

(2) an electromechanical device coupled to the first source of power and to the locking member for moving the locking member from the locked position to the unlocked position in response to at least one electric signal;

(3) a wireless receiving ("R") device, coupled to the first source of power, for receiving second unlock data;

(4) a first data memory, coupled to the first source of power, for storing first unlock data including biologic identification information pertaining to a person who is authorized to unlock the locking device; and (5) a first logic device, coupled to the first source of power, to the R device and to the first data memory, for comparing biologic identification information included in said second unlock data with biologic identification information included said first unlock data and for producing said at least on electric signal to actuate the electromechanical device, and thereby move the locking member to the unlock position, when the biologic identification information included in said first unlock data and the biologic Identification information included the second unlock data are substantially the same;

(b) a phone app for a portable smartphone which includes a second source of electrical power and comprise the following components:

(1) a wireless transmitting ("T") device coupled to said second source of power for transmitting said second unlock data to said R device;

(2) a second data memory, coupled to said second source of power, for storing said second unlock data;

(3) a second logic device, coupled to said second source of power, to said T device and to said second data memory; and (4) an input device, coupled to said second logic device and to said second source of power, for receiving biologic identification information of a putative authorized person who wishes to unlock the locking device, said phone app being operative to control said second logic device (i) to generate said second unlock data from said biologic identification information of said putative authorized person, (ii) to store said second unlock data in said second data memory and (iii) to cause said T device to transmit said second unlock data to said R device;

thereby to unlock said locking device when the biologic identification information include in said first unlock data and the biologic identification information included the second unlock data are substantially the same.

2. The locking apparatus of claim 1, wherein the input device of said smartphone includes a camera, coupled to said second logic device, and wherein the second logic device is further operative to process an image captured by said camera of a bodily feature of said putative authorized person as biologic identification information and to generate said second unlock data therefrom.

3. The locking apparatus of claim 1, wherein the input device of said smartphone includes a fingerprint sensor, coupled to said second logic device, and wherein the second logic device is further operative to process a fingerprint captured by said sensor from said putative authorized person as biologic identification information and to generate said second unlock data therefrom.

4. The locking apparatus of claim 1, wherein the portable smartphone further includes a microphone, coupled to said second logic device, and wherein the second logic device is further operative to process information representing a voice spoken into the microphone by the putative authorized person as biologic identification information and to generate said second unlock data therefrom.

5. The locking apparatus of claim 1, wherein the portable smartphone further includes a keypad, coupled to said second logic device, for inputting alphanumeric data, and wherein the second logic device is further operative to process alphanumeric information entered into the keypad by the putative authorized person and to generate said second unlock data from said alphanumeric information and from said biologic identification information.

6. The locking apparatus of claim 1, wherein the portable smartphone further includes a keypad, coupled to said second logic device, for inputting alphanumeric data whereby a person may input a lock command, and wherein the second logic device is further operative to generate a lock signal representing said lock command, said data receiver is further operative to receive said lock signal, and said first logic device, upon receipt of said lock signal, is operative to produce at least one electric signal to actuate the electromechanical device and thereby move the locking member to the locked position.

7. The locking apparatus of claim 1, wherein said second logic device is operable to enable operation of said smartphone when said biologic identification information is entered in said input device by said putative authorized person, and wherein said biologic identification information is thereafter used to generate said second unlock data.

* * * * *